US009986815B2

(12) United States Patent
Moreau et al.

(10) Patent No.: US 9,986,815 B2
(45) Date of Patent: Jun. 5, 2018

(54) DROP-PREVENTION TOOL HARNESS FOR PISTOL-GRIP HAND TOOLS

(71) Applicant: TY-FLOT, INC., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 25 days.

(21) Appl. No.: 15/274,196

(22) Filed: Sep. 23, 2016

(65) Prior Publication Data

US 2018/0084894 A1 Mar. 29, 2018

(51) Int. Cl.
*A45F 5/00* (2006.01)
*A45F 5/02* (2006.01)
*B25H 3/00* (2006.01)

(52) U.S. Cl.
CPC ..... *A45F 5/021* (2013.01); *B25H 3/006* (2013.01); *A45F 2200/0575* (2013.01); *Y10S 224/904* (2013.01)

(58) Field of Classification Search
CPC .. B25H 3/006; A45F 5/021; A45F 2200/0575; A45F 2200/0591; A45F 2200/0566; A45F 2003/142; A45F 2005/006; Y10S 224/904; Y10S 224/911; F41C 33/0245; F41C 33/046; F41C 33/0236
USPC .... 24/150, 250, 254, 911, 269, 148.5, 148.6
See application file for complete search history.

(56) References Cited

U.S. PATENT DOCUMENTS 4,867,359 A * 9/1989 Donovan ..... A43B 5/0425 224/250
5,535,928 A * 7/1996 Herring ..... A45F 5/02 224/250
5,622,346 A * 4/1997 Story, Jr. ..... A45F 5/02 224/148.6
8,011,541 B2 * 9/2011 Mikesell ..... B25H 3/006 224/250
2006/0237498 A1 * 10/2006 Piatt, Sr. ..... A45F 5/02 224/269
2017/0027308 A1 * 2/2017 Christman ..... A45F 3/14

* cited by examiner

*Primary Examiner* — Scott McNurlen
(74) *Attorney, Agent, or Firm* — Mesmer & Deleault, PLLC; Robert Deleault; Sarita Pickett

(57) ABSTRACT

A drop-prevention tool harness for pistol-grip hand tools includes a sleeve member sized to be installed around a gear housing of a pistol-grip hand tool. A tool body strap defines a flattened closed loop that extends around a wall of the sleeve member and extends to a rearward end portion spaced apart from the sleeve member. A handle strap is connected to the rearward end portion of the tool body strap and has first and second handle strap portions that extend to respective first and second handle strap end portions each defining a closed loop. The first closed loop is sized to permit passage therethrough by the second handle strap end portion. An optional handle band is sized and constructed to be installed around the handle strap and hand grip of a pistol-grip hand tool.

10 Claims, 8 Drawing Sheets

DROP-PREVENTION TOOL HARNESS FOR PISTOL-GRIP HAND TOOLS

BACKGROUND OF THE INVENTION

1. Field of the Invention

The present invention relates generally to safety accessories for hand tools and more particularly to a drop-prevention apparatus for hand-held power tools having a pistol-grip configuration.

2. Description of the Prior Art

Lanyards, tethers, hooks, and similar restraints are used to prevent accidental dropping of tools. These restraints are particularly useful in environments where a tool drop can cause substantial damage or harm to plant equipment, workers, or objects below a worker who accidentally drops a tool.

One method of restraining tools is to clip one end of a tether to an opening in the handle of a tool (e.g., a D-ring built into the tool's handle) and to clip the other end of the tether to the worker's belt or to a nearby structure. When workers properly tether a tool in this way, accidental drops can be eliminated or greatly reduced. However, due to safety concerns, aesthetic preferences, and to practical design limitations, many hand-held power tools lack attachment points for tethers.

While hand tools without moving parts may have openings or tether-attachment points, powered hand tools often do not. For example, cordless impact drivers and drills include a battery pack attachable to the end of the hand grip. Since it is removable, the battery pack is not an optimal location for a tether attachment point. Also, adding a tether attachment point to the hand grip may not be comfortable during use and it may not look pleasing in sales brochures. Further, manufacturers' concerns about product liability for harm caused by a tether becoming tangled with tool or other equipment lead to the manufacturers eliminating the tether-attachment feature altogether.

The problem of tethering a cordless drill has been addressed in one approach by looping a tether around the handle of the drill in a slip-knot fashion or the like. After looping around the handle, the tether is attached to the user's person or to a nearby structure. To prevent the cord from slipping off of the end of the drill's handle, this approach relies on the difference in size between the hand grip and the larger battery pack or butt of the handle.

Another approach to the problem of tethering a cordless drill is a tool wrap that has a cover formed with large straps and a connector ring. The cover is shaped to loosely slip over the block-shaped battery pack and then is secured to the battery pack by tightening the straps around the battery pack. A first strap is connected at one end of the cover and wraps over the top and around the battery pack in front of the handle. A second strap connects at one end to the front end or "toe" of the cover and wraps horizontally along the side of the battery pack, around the "heel" of the battery pack, and along the opposite side of the battery pack where it connects with hook-and-loop fasteners on the cover. The second strap passes through and retains a connector ring near the "heel" of the battery pack. A tether may be connected to the connector ring.

SUMMARY OF THE INVENTION

Although solutions for tethering a cordless drill with battery pack have been presented, these tethering devices are ill-suited for pneumatic, hydraulic, and corded power tools such as impact drivers and drills since these tools do not have a battery pack. Despite being connected to an electrical cord or supply hose for compressed air or hydraulic fluid, the hand tool still poses a hazard when dropped. In the case of an electrical cord, the cord easily becomes disconnected from an extension cord or from an electrical outlet when the tool is dropped. In the case of hydraulic or pneumatic tools, the supply hose connector is not reliable to retain a dropped tool and the hose often extends to the ground where it is useless to stop the falling tool.

Additionally, the tethering approaches of the prior art are intended for hand tools having a weight of five pounds or less. Reliable tethering devices and methods are not currently available for tools weighing from six to thirty pounds or more. Therefore, an alternative approach is needed to tethering pistol-grip hand tools, such as impact wrenches, drills, riveters, nutrunners, rotary sanders, and other tools having a hand grip that extends transversely down from a generally-horizontal tool body with gear housing, particularly those pistol-grip hand tools having a weight above five pounds. Accordingly, an object of the present invention is to provide a drop-prevention tool harness for hand-held power tools having a pistol-grip extending transversely down from the tool body.

The present invention achieves this and other objectives by providing a drop-prevention tool harness pouch for hand-held power tools having a pistol-grip configuration and method of tethering a pistol-grip hand tool.

In one embodiment, a drop-prevention tool harness for a pistol-grip hand tool includes a sleeve member extending along a central sleeve axis, where the sleeve member has a sleeve wall and defines an opening sized to be installed around a gear housing of a pistol-grip hand tool. A tool body strap defines a flattened closed loop that extends around and captures the wall of the sleeve member. The tool body strap extends to a rearward end portion spaced apart from the sleeve member in a direction generally parallel to the central sleeve axis. A handle strap is connected to the rearward end portion and has a first handle strap portion extending down from a first side to a first handle strap end portion defining a first closed loop. A second handle strap portion extends down from an opposite second side to a second handle strap end portion and defines a second closed loop. The first closed loop is sized to permit passage therethrough by the second handle strap end portion. In some embodiments, the tool harness includes first and second tool body straps configured to extend along the side surface of the tool body in addition to or as an alternative to a top tool body strap extending along the top surface of the pistol-grip hand tool.

In another embodiment, the tool harness also includes a handle band configured to be installed snugly over the handle strap and a hand grip of the pistol-grip hand tool when the tool harness is installed on the pistol-grip hand tool with the tool body strap extending along a top surface of the pistol-grip hand tool and the first handle strap portion and second handle strap portion each extending down along the hand grip. In one embodiment, the handle band is selected as heat shrink tubing, rubber tubing provided in an expanded state over a removable core, an adjustable strap, a length of self-amalgamating tape, or a length of adhesive tape.

In another embodiment, the handle band is a strap fixedly attached to extending transversely from the first handle strap portion or the second handle strap portion. The strap is positioned along the first handle strap portion or the second handle strap portion to be wrapped around a hand grip of the pistol-grip hand tool when the tool harness is installed on the pistol-grip hand tool with the tool body strap extending along a top and/or side surface of the pistol-grip hand tool and the first handle strap portion and second handle strap portion each extending down along the hand grip. For example, the handle band strap includes a first band portion and a second band portion extending in opposite directions from the first handle strap portion or the second handle strap portion.

In some embodiments, one or both of the first closed loop and the second closed loop is a closed-loop connector.

In another embodiment, the handle strap is fixedly secured to the rearward end portion of the tool body strap. In one such embodiment, when installed on a pistol-grip hand tool with the tool body strap extending along a top surface of the pistol-grip hand tool, the first handle strap portion is sized to extend from the tool body strap down along the hand grip with the first closed loop located adjacent a bottom end of the hand grip when the second handle strap end portion passes through the first closed loop.

In another embodiment, the rearward end portion of the tool body strap defines a rear loop opening. A middle portion of the handle strap slidably extends through the rear loop opening, thereby enabling adjustment of a length of the first handle strap portion relative to the second handle strap portion.

Another aspect of the present invention is directed to a method of tethering a pistol-grip hand tool. In one embodiment, the method includes the steps of providing a pistol-grip hand tool having a tool body with a top surface, a gear housing on a forward end of the tool body, and a hand grip extending transversely down from the tool body; providing a tool harness for drop prevention including (i) a sleeve member sized and constructed to be installed around the gear housing of the pistol-grip hand tool, (ii) one or more tool body strap defining a flattened closed loop that extends around a wall of the sleeve member, each tool body strap extending to a rearward end portion spaced apart from the sleeve member, and (iii) a handle strap fixedly attached to the rearward end portion of the tool body strap and having a first handle strap portion extending down from a first side of the tool body strap (or from a first tool body strap) to a first handle strap end portion defining a first closed loop and having a second handle strap portion extending down from a second side of the tool body strap (or from a second tool body strap) to a second handle strap end portion defining a second closed loop, where the first closed loop is sized to permit passage therethrough by the second handle strap end portion. The method also includes installing the sleeve member around the gear housing of the pistol-grip hand tool, aligning the tool body strap to extend rearward of the sleeve member along the tool body, positioning the first handle strap portion to extend down along a first side of the hand grip of the pistol-grip hand tool, positioning the second handle strap to extend down along a second side of the hand grip of the pistol-grip hand tool; and inserting the second handle strap end portion through the first closed loop on the first handle strap end portion. In some embodiments, the tool body strap is a single strap extending along the top surface of the pistol-grip hand tool. In other embodiments, the tool body strap additionally or alternately includes tool body straps extending along the side surface of the pistol-grip hand tool.

In one embodiment, the providing step includes selecting the sleeve member as heat-shrink tubing and the step of installing the sleeve member includes heating the heat-shrink tubing to cause the shrink tubing to conform to the size and shape of the gear housing.

In another embodiment, the method also includes the steps of providing a handle band sized and constructed to be installed around and tightened on the handle strap and the hand grip of the pistol-grip hand tool as the handle strap extends along the hand grip; installing the handle band around the hand grip with the first handle strap portion and the second handle strap portion extending down along opposite lateral sides of the hand grip, where the first handle strap portion and the second handle strap portion each extends between the hand grip and the handle band; and tightening the handle band around the hand grip and the handle strap, thereby restricting movement of the first handle strap portion and the second handle strap portion.

In another embodiment, the step of providing the handle band includes selecting the handle band as heat-shrink tubing, cold-shrink tubing provided in an expanded state over a removable core, elastomeric tubing that can be stretched for installation on the handle, a strap, a length of self-amalgamating tape, or a length of adhesive tape. In one embodiment where the handle band is the cold-shrink tubing provided in the expanded state, the step of tightening the handle band includes removing the removable core to cause the rubber tubing to assume a reduced size and snugly grip the hand grip and handle strap.

In another embodiment, the step of providing the handle band includes selecting a handle band that is fixedly attached to the first or second handle strap portion.

In another embodiment, the handle band is selected as the strap, where the strap extends perpendicularly to the first handle strap portion or the second handle strap portion.

In another embodiment, the method also includes the step of providing a tether having a first tether end and a second tether end, attaching the first tether end to the second closed-loop on the second handle-strap end portion, and attaching the second tether end to the user or to a nearby structure.

In another embodiment, the step of providing the pistol-grip hand tool includes selecting the hand grip to extend down from the tool body at an angle from 90 to 110 degrees.

DETAILED DESCRIPTION OF THE PREFERRED EMBODIMENT

The preferred embodiments of the present invention are illustrated in FIGS. 1-11. As used herein, the terms "up," "down," "forward," "rearward," "top," "bottom," and similar terms refer to the orientation of a pistol-grip hand tool 10 as typically oriented during display or use, where a hand grip 12 extends transversely down from a generally-horizontal tool body 14, and where a gear housing 16 is positioned forward of the hand grip 12 on a forward portion 14*a* of tool body 14. These terms are used for convenience in describing the present invention and do not limit the use or structure of the invention to any specific orientation.

Figure 1:
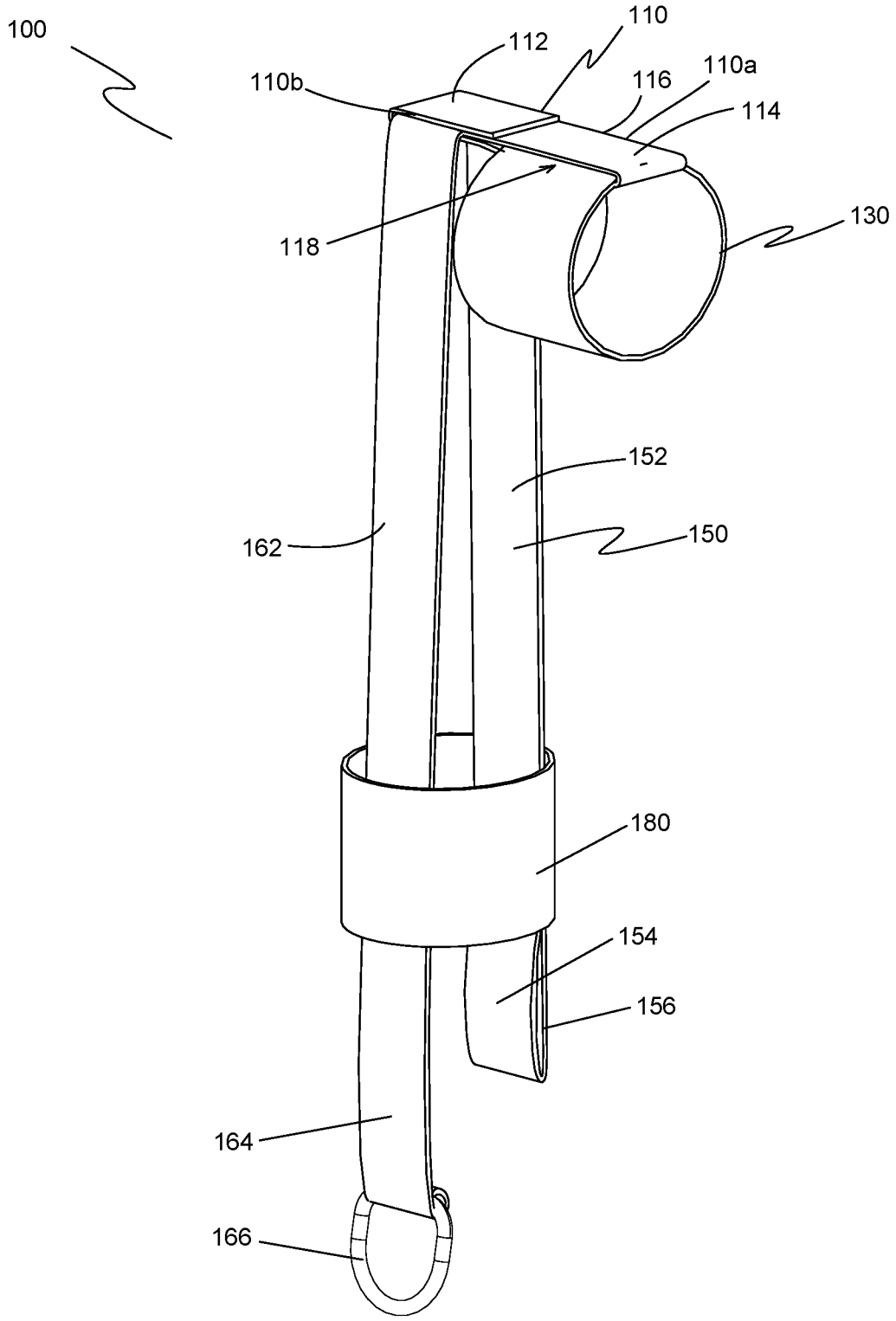
FIG. 1 is a front, top, and side perspective illustration showing one embodiment of a tool harness of the present invention including a sleeve member, a tool body strap, a handle strap, and a handle band.
Figure 9:
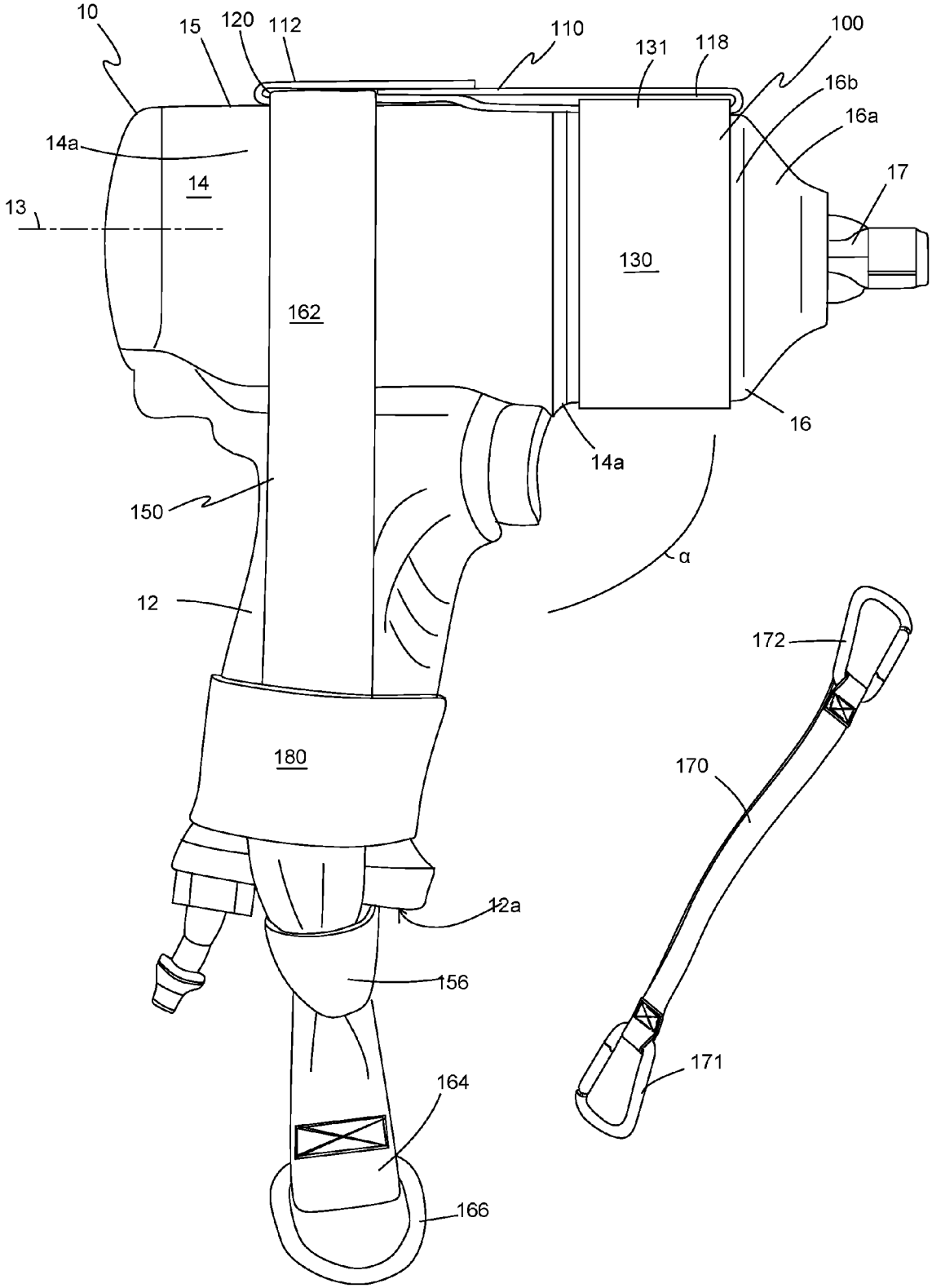
FIG. 9 is a side elevational view of the tool harness of FIG. 1 shown installed on one embodiment of a pistol-grip hand tool.
Figure 10:
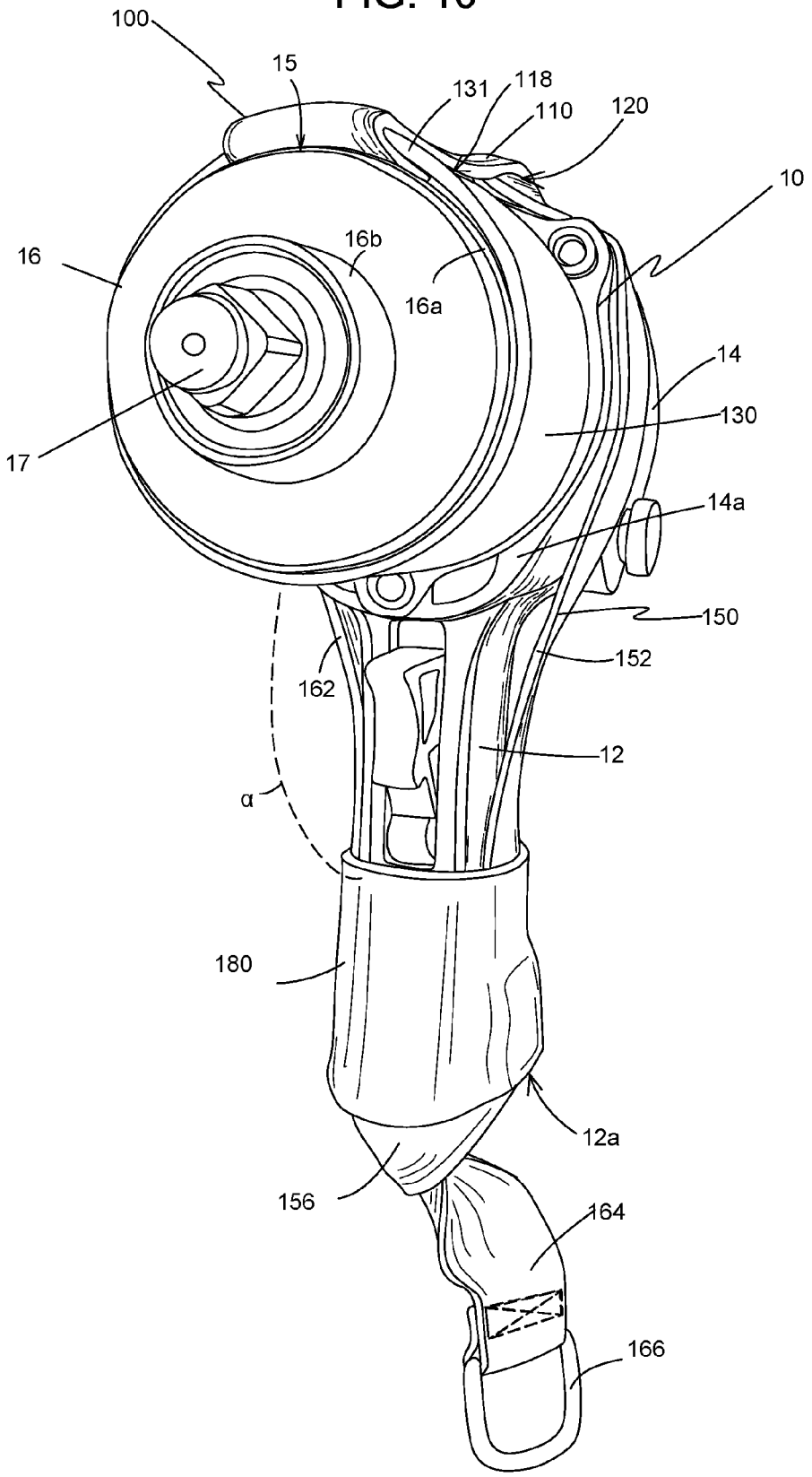
FIG. 10 is a front and left-side perspective view showing the tool harness of FIG. 1 installed on another embodiment of a pistol-grip hand tool.

FIG. 1 illustrates a side, top, and rear perspective view of one embodiment of a tool harness 100 useful for tethering a pistol-grip hand tool 10 (shown, for example, in FIGS. 9-10). Tool harness 100 includes a tool body strap 110 extending generally horizontally, where the tool body strap 110 is configured to extend along a top surface 15 of pistol-grip hand tool 10. Alternately or additionally, tool body strap 110 may be first and second tool body straps 110', 110" that extend along opposite lateral sides of tool body 14. A forward end portion 114 of tool body strap 110 is looped around and captures a sleeve member 130 that is sized to be installed around gear housing 16 of pistol-grip hand tool 10. Sleeve member 130 may be, for example, heat-shrink tubing; rubber tubing provided in an expanded state and supported by a removable core (i.e., "cold-shrink" tubing); an adjustable strap; a cylindrical sleeve made of plastic, metal, or other rigid or semi-rigid materials; or a flexible sleeve made of fabric, leather, plastic, or the like.

A handle strap 150 is attached to or connected to a rearward end portion 112 of tool body strap 110. Handle strap 150 has a first handle strap portion 152 and a second handle strap portion 162, each of which extends down from opposite sides 110*a*, 110*b* of tool body strap 110, respectively. When installed on pistol-grip hand tool 10, first and second handle strap portions 152, 162 are configured to extend down along opposite lateral sides of a hand grip 12 of pistol-grip hand tool 10. A first handle strap end portion 154 defines a first closed loop 156 and second handle strap end portion 164 defines a second closed loop 166. First closed loop 156 is sized to receive therethrough second handle strap portion 162.

Tool harness 100 optionally includes a handle band 180 that can be installed over and tightened around handle strap 150 and hand grip 12 of pistol-grip hand tool 10. Handle band 180 may be made, for example, of heat-shrink tubing, rubber tubing provided in an expanded state supported by a removable core (i.e., "cold-shrink tubing"), elastomeric tubing, an adjustable strap, adhesive tape, grip tape, or self-amalgamating tape. When handle band 180 is heat-shrink tubing, for example, handle band 180 is placed in the pre-shrink state over the hand grip and first and second handle strap portions 152, 162 and then heated to cause it to shrink and conform to hand grip 12 with handle strap 150 extending along each side of hand grip 12. When handle band 180 is tape, for example, the tape is wrapped tightly around hand grip 12 and handle strap 150.

Figure 2:
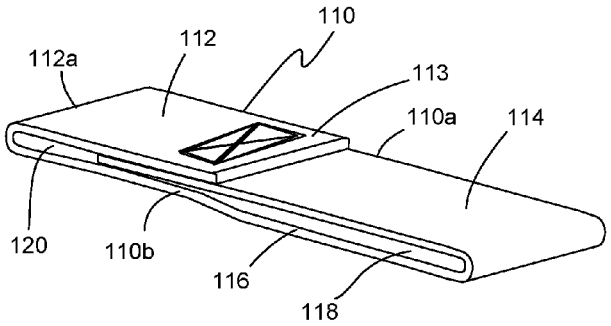
FIG. 2 is a front, top, and side perspective illustration of the tool body strap shown in FIG. 1.

Turning now to FIGS. 2-5, components of tool harness 100 of FIG. 1 are shown individually in perspective illustrations. As shown in FIG. 2, tool body strap 110 extends from rearward end portion 112 to forward end portion 114. Forward end portion 114 defines a front loop opening 118 that is sized to receive wall 131 of sleeve member 130 therethrough, thereby capturing sleeve member 130. In one embodiment, tool body strap 110 is made of flexible material defining a flattened closed loop 116 with front loop opening 118 along forward end portion 114. For example, tool body strap 110 is webbing made of woven or solid nylon, polypropylene, polyester or other material; leather, cloth, metal, or other flexible, semi-flexible, or rigid materials. Preferably, tool body strap 110 is made of flexible materials so that it conforms easily to the shape of the top surface 15 or side surface 14*a* of the tool body 14, but such conformity is not required. In some embodiments, tool body strap 110 is made of rigid material and has a general shape corresponding to top surface 15 or side surface 14*a* of selected pistol-grip hand tool 10. Optionally, tool body strap 110 is made of a rigid material and is shaped to mate with a specific pistol-grip hand tool 10 or group thereof.

In one embodiment as shown, rearward end portion 112 defines a rear loop opening 120. Front and rear loop openings 118, 120 are passageways extending generally perpendicularly to tool body strap 110. In other embodiments, rearward end portion 112 does not define an opening, but instead is an extension of one or more plies of material used to make tool body strap 110. In yet another embodiment, rearward end portion 112 extends as a single ply of material from a middle portion 113. Optionally, tool body strap 110 is folded on itself at rearward end 112*a* and secured to define a catch or stop against which handle strap 150 is positioned.

In one embodiment as shown in FIG. 2, tool body strap 110 is secured to itself at middle portion 113 between front loop opening 118 and rear loop opening 120, such as by stitching, rivets, a grommet, fastener, adhesive, or other suitable means. One use for such a configuration is that front and rear openings 118, 120 are separated and distinct from each other, thereby maintaining a spaced-apart orientation of sleeve member 130 and handle strap 150 as it interfaces with tool body strap(s) 110. In other embodiments, tool body strap 110 is made of flexible material that is flattened into an elongated, flattened closed loop with a single loop opening 118.

Figure 3:
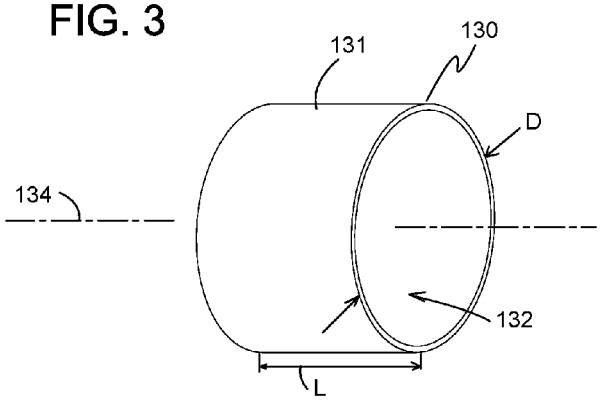
FIG. 3 is front, top, and side perspective illustration of the sleeve member shown in FIG. 1.

Referring now to FIG. 3, one embodiment of sleeve member 130 is illustrated in a side and front perspective view. Sleeve member 130 defines or can be made to define a closed loop with a through-passageway 132 extending along a central sleeve axis 134. Sleeve member 130 has a wall 131 that extends through front loop opening 118 of tool body strap 110. Central sleeve axis 134 is generally horizontal. In one embodiment, sleeve member 130 is made of heat-shrink tubing, cold-shrink tubing, or rubber tubing. For example, sleeve member 130 is heat-shrink tubing that reduces in size when heated. In another example, sleeve member 130 is cold-shrink tubing provided in an expanded state supported by a removable core, where the cold-shrink tubing assumes a smaller size when the core is unraveled and removed from the tubing. In another example, sleeve member 130 is elastomeric tubing that can be stretched by the user to fit over gear housing 16 or an adjustable flexible strap that can be wrapped around gear housing 16. For example, the flexible strap is a length of nylon or other webbing with a releasable fastener, where the webbing can be wrapped around gear housing 16 of pistol-grip hand tool 10 and tightened for a snug fit to gear housing 16. The releasable fastener may be, for example, hook-and-loop fastener, a buckle, two D-rings, a slider buckle, or some other fastener. In yet another embodiment, sleeve member 130 is a length of tape, such as self-amalgamating tape, that is looped in a plurality of overlapping wraps around gear housing 16 while also passing through front loop opening 118 of tool body strap(s) 110. In still other embodiments, sleeve member 130 is a metal or plastic tube or two-piece collar, such as a two-piece clamshell-type shaft collar or the like.

When sleeve member 130 is shrink tubing, the shrink tubing is sized to snugly fit on and grip gear housing 16 when it assumes a reduced size. In one exemplary embodiment intended for an impact wrench, sleeve member 130 is heat-shrink tubing having a length L of about 1.75" and a diameter D of about 3" before heat treatment. After installation, the heat-shrink tubing shrinks to snugly engage gear housing 16, which has a length of about 2.25" and diameter of 2.5".

Figure 4:
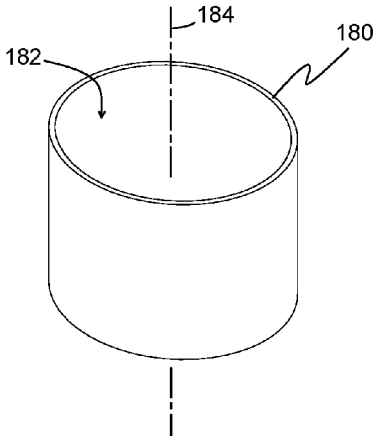
FIG. 4 is a front, top, and side perspective illustration of the optional handle band shown in FIG. 1.

Referring now to FIG. 4, a perspective view shows one embodiment of optional handle band 180. Similar to sleeve member 130, handle band 180 defines or can be made to define a closed loop with a through-passageway 182 extending along a central handle-band axis 184. When installed, central handle-band axis 184 is generally parallel to hand grip 12 of pistol-grip hand tool 10 (shown, for example, in FIGS. 9-10). Handle band 180 may be made of heat-shrink tubing, cold-shrink tubing, a flexible and adjustable strap, a wrap, a length of tape, a metal band, and the like. Since handle band 180 is spaced further from moving parts of pistol-grip hand tool 10 than sleeve member 130, a strap or length of webbing may be considered more appropriate for handle band 180 than for sleeve member 130 due to safety considerations.

Handle band 180 is often a separate component from handle strap 150 for ease of installation, but may be fixedly attached to or retained by one or both of first handle strap portion 152 and second handle strap portion 162. For example, handle band 180 is secured permanently or temporarily to second handle strap portion 162 by stitching, adhesive, or other means. In another example, handle band 180 extends through a loop defined by second handle strap portion 162.

Figure 5:
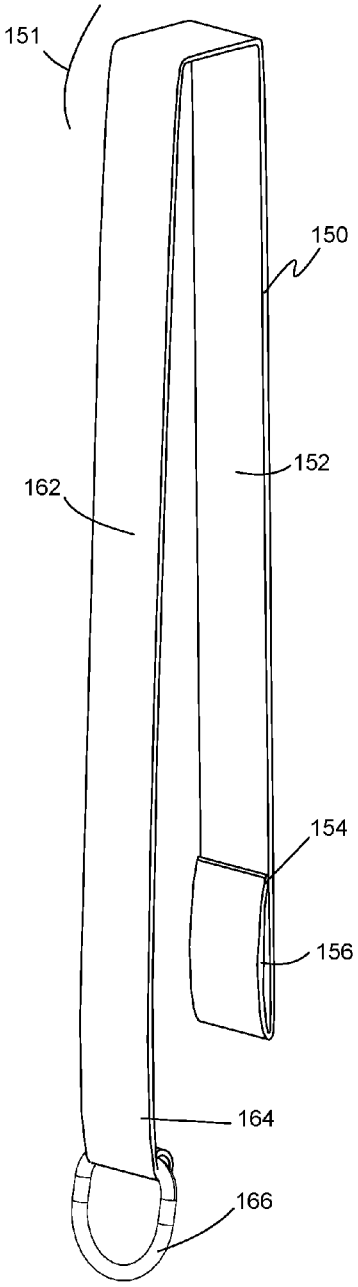
FIG. 5 is a front, top, and side perspective illustration of the embodiment shown in FIG. 1.

Referring now to FIG. 5, a perspective view illustrates one embodiment of handle strap 150 that includes first handle strap portion 152 and second handle strap portion 162 extending in a spaced-apart, generally parallel relationship down from handle strap middle portion 151. Handle strap middle portion 151 extends through rear loop opening 120 (when present) or may be secured to rearward end portion 112 of tool body strap 110. In some embodiments, handle strap 150 extends unsecured through rear loop opening 120 so that the relative position of first handle strap end portion 154 and second handle strap end portion 164 can be adjusted. In another embodiment, handle strap middle portion 151 is secured to rearward end portion 112 of tool body strap 110, such as by stitching.

First handle strap end portion 154 defines first closed loop 156 and second handle strap end portion 164 defines second closed loop 166, where second handle strap end portion 164 can pass through first closed loop 156. First closed loop 156 and second closed loop 166 may be or may include a closed-loop fastener (e.g., a D-ring or carabiner), may be a loop formed by first or second handle strap end portion 156, 166 fixedly attached to itself, or may be an opening defined in first and/or second handle strap end portion 156, 166 (e.g., a slit, hole, or opening with another shape).

In one embodiment, handle strap 150 is made of flexible material, such as webbing made of woven or solid nylon, polypropylene, polyester or other material; leather, cloth, plastic, or other flexible or semi-flexible materials.

Figure 6:
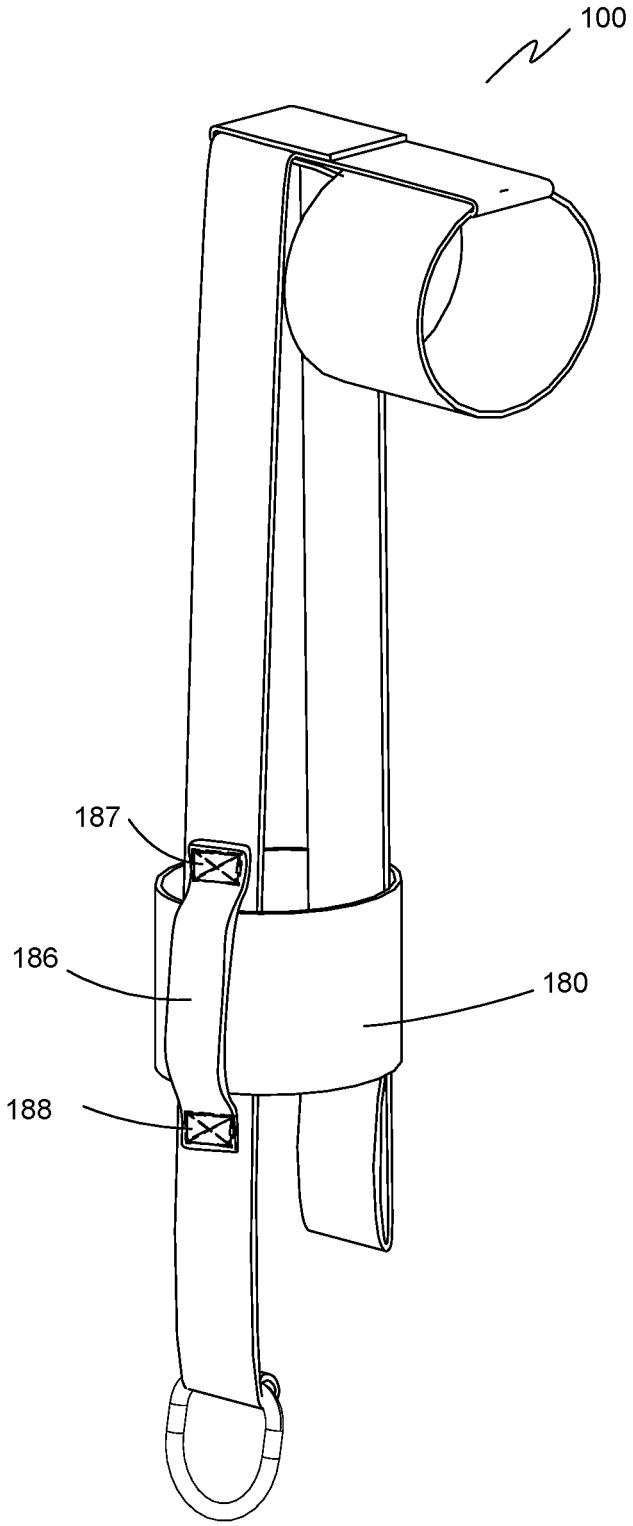
FIG. 6 is a front, top, and side perspective illustration of another embodiment of a tool harness of the present invention showing a loop on the second handle strap portion capturing the handle band.

Referring now to FIG. 6, a perspective illustration shows another embodiment of tool harness 100 where handle band 180 is retained by a loop 186 attached to second handle strap portion 162. As shown, loop 186 is formed by a length of webbing stitched at each end 187, 188 to second handle strap portion 162 with handle band 180 passing through loop 186. Loop 186 could similarly be defined by a metal strap guide or other hardware. Handle band 180 could alternately or additionally be retained by or attached to first handle strap portion 152.

Figure 7:
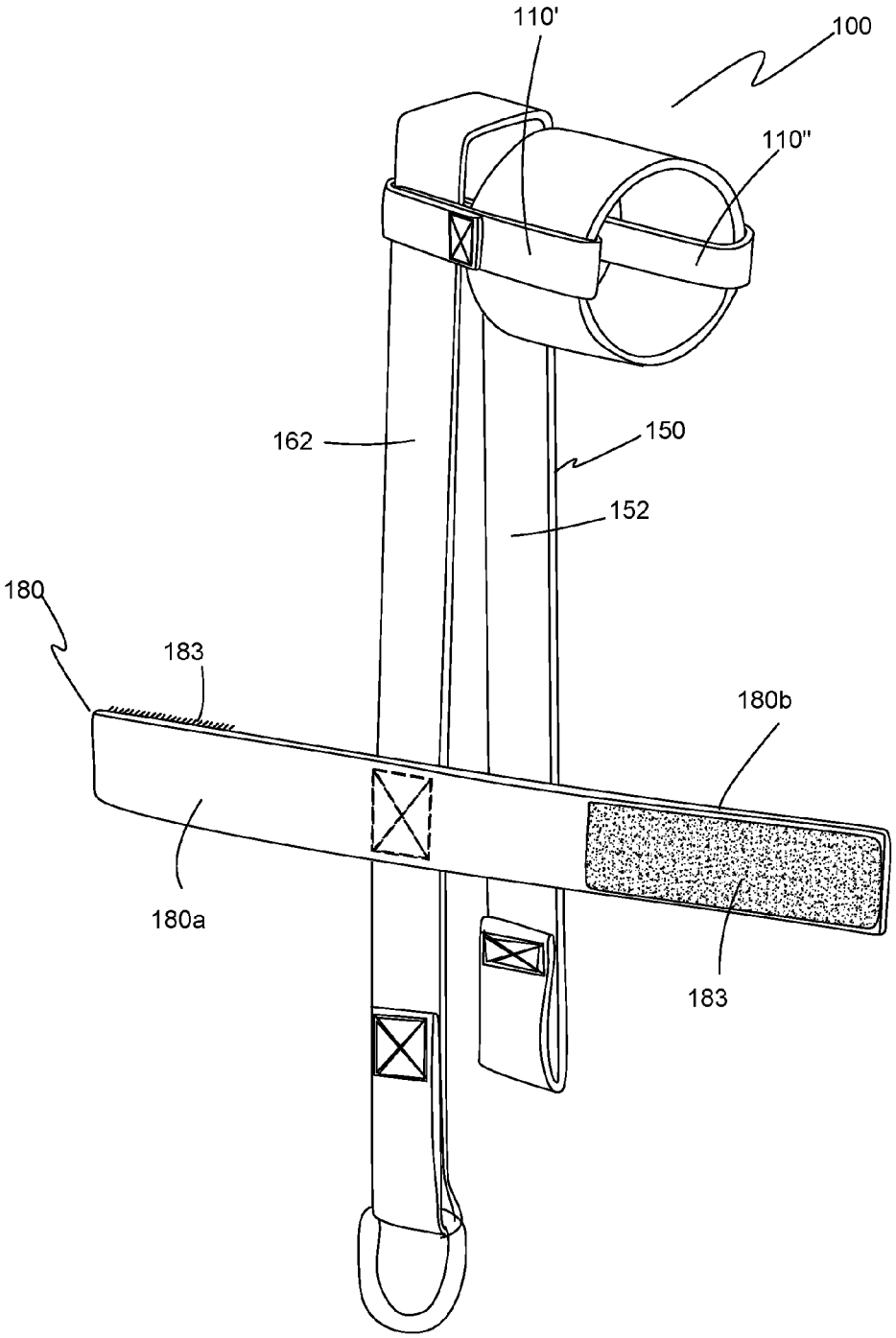
FIG. 7 is a front, top, and side perspective illustration of another embodiment of a tool harness of the present invention showing a handle band configured as a strap that is attached to the second handle strap portion and showing two tool body straps positioned to extend along the sides of the hand tool from the sleeve member.

Referring now to FIG. 7, a perspective view illustrates yet another embodiment of tool harness 100 where handle strap 150 includes optional handle band 180 configured as a strap secured to second handle strap portion 162. In this embodiment, handle band 180 is configured as a strap that is fixedly attached by stitching to second handle strap portion 162 and extends transversely (e.g., perpendicularly) to second handle strap portion 162. Handle band 180 extends substantially perpendicularly to second handle strap portion 162 and is sized to wrap around hand grip 12 of pistol-grip hand tool 10 and secure to itself using a fastener 183. For example, handle band 180 is a length of nylon webbing with a hook-and-loop fastener 183 or other fastener 183 such as a snap, button & button hole, buckle, and the like. In one embodiment, handle band 180 includes a first band portion **180*a* and a second band portion 180*b* extending in opposite directions from first or second handle strap portion 152, 162**.

As also shown in FIG. 7, a plurality of tool body straps 110' 110" each capture sleeve member 130 and are configured to extend along the opposite side surfaces **14*a* of tool body 14. In this embodiment, a first tool body strap 110' is configured to extend along a side surface 14*a* and a second tool body strap 110" is configured to extend along an opposite side surface 14*a* of the pistol-grip hand tool 10. This embodiment is particularly useful when sleeve member 130 is made of metal or plastic, where first and second tool body straps 110', 110" extend along opposite side surfaces 14*a* of tool body 14. First and second tool body straps 110', 110" may be used in addition to or in place of tool body strap 110 extending along top surface 15 of pistol-grip hand tool 10 as shown in FIG. 1**.

Figure 8:
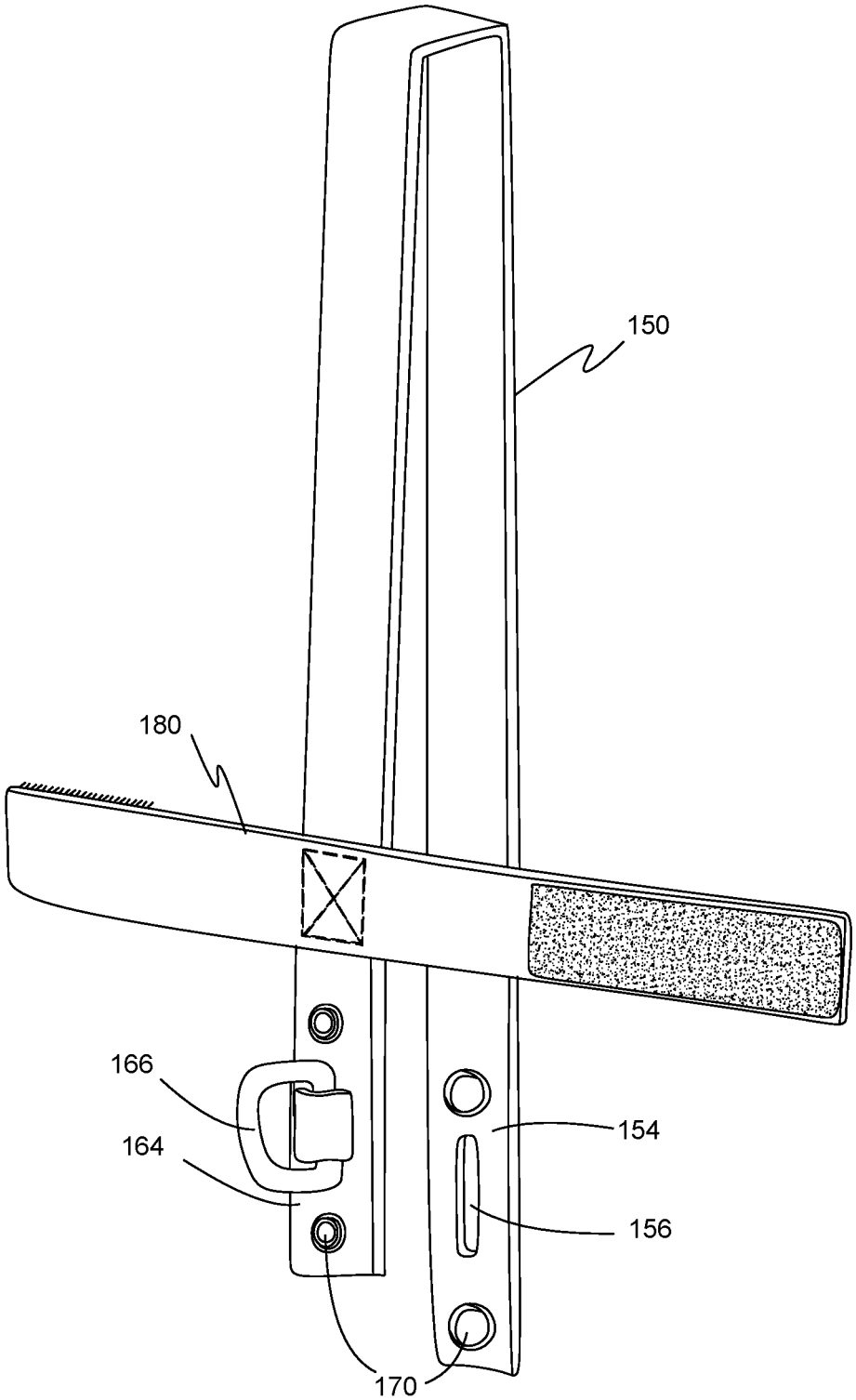
FIG. 8 is a front, top, and side perspective illustration of another embodiment of a handle strap showing a first handle strap end portion with a slot and a second handle strap end portion with the D-ring that inserts through the slot in the first handle strap end portion.

Referring now to FIG. 8, a perspective view illustrates yet another embodiment of handle strap 110, where first handle strap end portion 154 and second handle strap end portion 164 are configured to extend around a bottom end **12*a* of hand grip 12 of pistol-grip hand tool 10 and attach to each other using fasteners 170. First closed loop 156 is a slot in first handle strap end portion 154 that receives therethrough second closed loop 166 (a D-ring) when first and second handle strap end portions 154, 164 overlap. Accordingly, handle strap 150 defines a closed loop extending around top surface 15 of tool body 14 and bottom end 12*a* of hand grip 12. For example, first handle strap end portion 154 wraps around bottom end 12*a* and overlaps and attaches to second handle strap end portion 164 with fastener 170, such as snaps, a hook-and-loop fastener, or some other fastener 170**.

Turning now to FIGS. 9 and 10, the embodiment of tool harness 100 of FIG. 1 is shown installed on two examples of pistol-grip hand tool 10. In both of FIGS. 9 and 10, pistol-grip hand tool 10 is a pneumatic impact wrench with tool body 14 extending along tool body axis 13 and with hand grip 12 extending transversely down from tool body 14 at an angle α of about 100° with respect to tool body axis 13. In its customary orientation, tool body axis 13 is generally horizontal. Gear housing 16 is part of or attaches to forward portion 14*a* of tool body 14. Gear housing 16 includes a cylindrical housing section 16*a* and a housing tip section 16*b* that opens to a rotating tool head 17. Housing tip section 16*b* may be tapered as shown in FIG. 9, may be a region of reduced diameter as shown in FIG. 10, or may have some other shape.

Tool harness 100 is installed on pistol-grip hand tool 10 with tool body strap 110 extending along top surface 15 of tool body 14. Sleeve member 130 snugly wraps around and conforms to cylindrical housing section 16*a* of gear housing 16. Top wall 131 of sleeve member 130 extends through and is captured by front loop opening 118 of tool body strap 110. Handle strap 150 extends through and is captured by rear loop opening 120 and over top surface 15 of pistol-grip hand tool 10 with first and second handle strap portions 152, 162 extending down along opposite lateral sides of hand grip 12. Second handle strap end portion 164 passes through first closed loop 156 of first handle strap end portion 154 and is pulled tight or cinched so that first closed loop 156 is positioned against bottom end 12*a* of hand grip 12. After second handle strap portion 162 passes through first closed loop 156, second closed loop 166 (a D-ring) is available for connection to first tether end 171 or second tether end 172 of a tether 170.

In one embodiment, handle strap 150 is secured to rearward end portion 112 of tool body strap 110, such as by stitching. This configuration provides predefined lengths for first and second handle strap portions 152, 162. In one embodiment, first handle strap portion 152 has a predefined length so that first handle strap portion 152 extends along hand grip 12 with first closed loop 156 beginning approximately at or just below bottom end 12*a* of hand grip 12. Accordingly, second handle strap end portion 164 extends through first closed loop 156 and can be pulled tight so that first closed loop 156 abuts bottom end 12*a* of hand grip 12. In other embodiments, handle strap 150 is not secured to rearward end portion 112, but instead is allowed to slide through rear loop opening 120 of tool body strap 110 so that the lengths of first and second handle strap portions 152, 162 can be adjusted as needed. Accordingly, first closed loop 156 can be positioned against bottom end 12*a* of hand grip 12 when second handle strap portion 162 extends through first closed loop 156.

As shown in FIGS. 9-10, optional handle band 180 is a length of shrink tubing that has been placed over hand grip 12 and handle strap 150 in a pre-shrink or expanded state and then caused to assume a reduced size to snugly engage hand grip 12 and handle strap 150, depending on whether the shrink tubing is heat-shrink or cold-shrink tubing. As discussed above, handle band 180 may alternately be a strap or length of tape that is wrapped tightly around hand grip 12 and handle strap 150.

Figure 11:
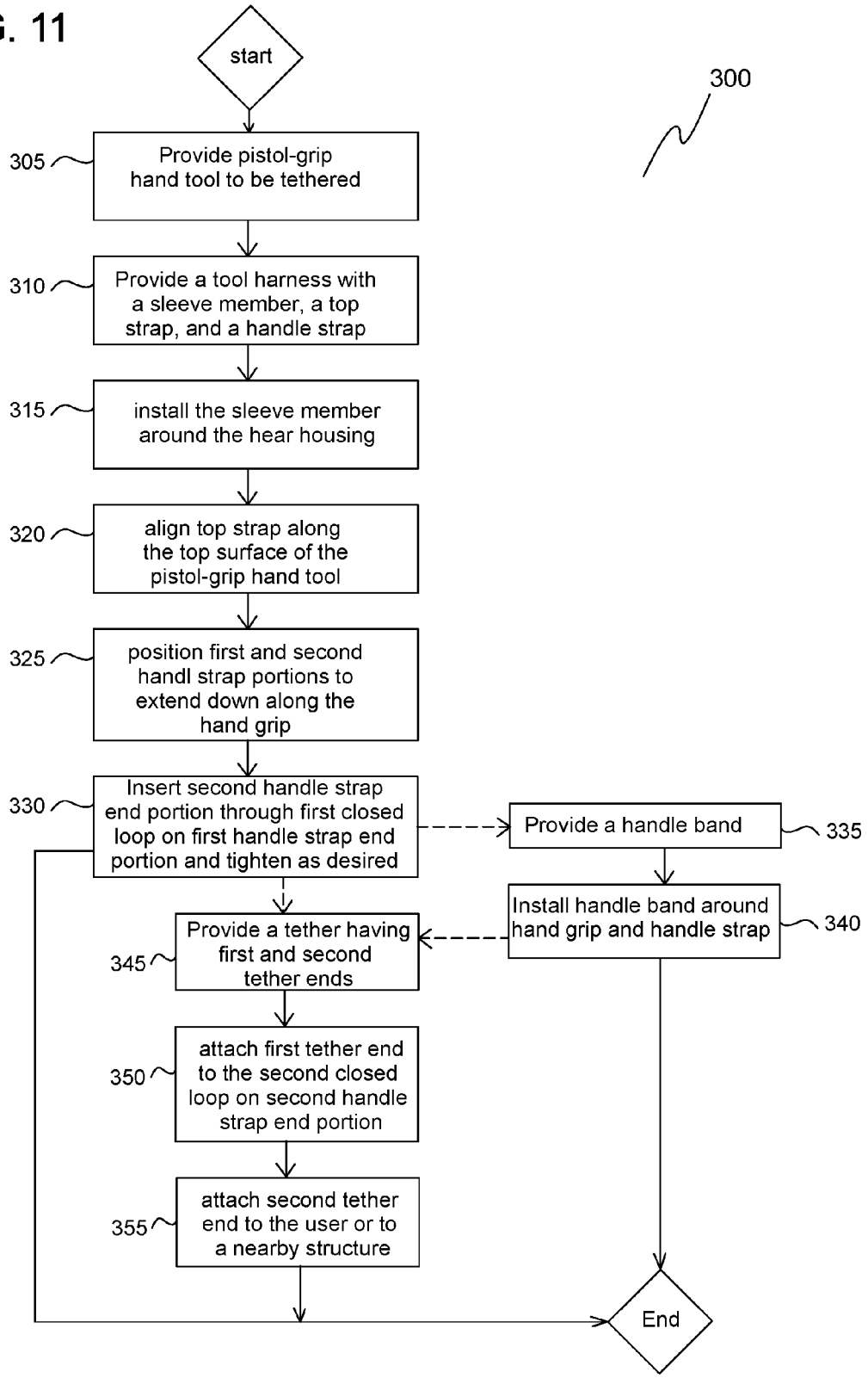
FIG. 11 is a flow chart of one embodiment of a method of tethering a pistol-grip hand tool of the present invention.

Referring now to FIG. 11, a flow chart illustrates steps in one exemplary embodiment of a method 300 of tethering a pistol-grip hand tool 10. The flowchart of FIG. 11 suggests one sequence of performing steps of method 300, however, the steps may be performed in a different order as appropriate or necessary.

In step 305, a pistol-grip hand tool 10 is provided, where pistol-grip hand tool 10 has tool body 14 extending along tool body axis 13, gear housing 16 on a forward end 14*a* of the tool body 14, and hand grip 12 extending transversely down from tool body 14. Typically, hand grip 12 and tool body axis 13 define an angle α from 90-115 degrees. When angle α is greater than 90°, hand grip 12 is canted rearward with respect to forward end 14*a* of tool body 14. More commonly, angle α is from 90-100 degrees. In some embodiments, pistol-grip hand tool 10 is an impact wrench, drill, or other tool powered by compressed air, hydraulic fluid, or electricity.

In step 310, a tool harness 100 for drop prevention is provided, where the tool harness 100 includes a sleeve member 130 constructed to be installed around the gear housing 16 of the pistol-grip hand tool 10, one or more tool body strap 110 defining a flattened closed loop that captures wall 131 of the sleeve member 130, and a handle strap 150 connected to the rearward end portion 112 of the tool body strap(s) 110. In embodiments where tool body strap 110 extends along the top surface 15 of the tool body 14, handle strap 150 has a first handle strap portion 152 extending down from a first side 110*a* of the tool body strap 110 to a first handle strap end portion 154 defining a first closed loop 156. Handle strap 150 also has a second handle strap portion 162 extending down from a second side 110*b* of the tool body strap 110 to a second handle strap end portion 164 defining a second closed loop 166. The first closed loop 156 is sized to permit passage therethrough by the second handle strap end portion 164.

In step 315, sleeve member 130 is installed around gear housing 16 of the pistol-grip hand tool 10. When sleeve member 130 is heat-shrink tubing or cold-shrink tubing, step 315 includes causing sleeve member 130 to assume a reduced size so that it snugly engages and grips gear housing 16. When sleeve member 130 is heat-shrink tubing, for example, installation includes heating the heat-shrink tubing, causing sleeve member 130 to shrink to a smaller size and conform to the size and shape of the gear housing 16. In embodiments, where sleeve member 130 is made of rigid materials, such as a plastic tube, sleeve member 130 is installed by fitting over gear housing 16 or inserting gear housing 16 into sleeve member 130.

In step 320, the tool body strap 110 is extended along and aligned with top surface 15 and/or side surfaces 14*a* of pistol-grip hand tool 10.

In step 325, first handle strap portion 152 and second handle strap portion 162 are positioned to extend down from tool body strap(s) 110 along opposite lateral sides of hand grip 12 of the pistol-grip hand tool 10.

In step 330, the second handle strap end portion 164 is inserted through the first closed loop 156 on the first handle strap end portion 154. Optionally and as needed, second handle strap portion 162 is pulled tight, or cinched, so that first closed loop 156 abuts bottom end 12*a* of hand grip 12.

In another embodiment, method 300 also includes step 335 and 340. In step 335, a handle band 180 is provided, where handle band 180 is sized and constructed to be installed around and tightened on handle strap 150 and hand grip 12 portion of the pistol-grip hand tool 10. In step 340 handle band 180 is installed around the hand grip 12 with the handle strap 150 extending along the hand grip 12, where the first handle strap portion 152 and the second handle strap portion 162 each extends between the hand grip 12 and the handle band 180. During installation, handle band 180 is tightened on hand grip 12 to restrict movement of first handle strap portion 152 and the second handle strap portion 162 as well as to avoid overly increasing the size of hand grip 12.

In one embodiment of method 300, handle band 180 is selected as shrink tubing, rubber tubing provided in an expanded state over a removable core, an adjustable strap, a length of self-amalgamating tape, or a length of adhesive tape. In an embodiment where handle band 180 is rubber tubing provided in the expanded state (i.e., "cold-shrink tubing"), step 340 of installing the handle band 180 includes removing the removable core to allow the rubber tubing to assume a reduced size and snugly grip and conform to the hand grip 12 and handle strap 150.

In another embodiment, method 300 also includes steps 345, 350, and 355. In step 345, a tether 170 is provided where the tether 170 has a first tether end 171 and a second tether end 172. In step 350, the first tether end 171 is connected to the second closed-loop on the second handle-strap end portion. In step 355, the second tether end 172 is connected to the user or to a nearby structure.

In use, embodiments of tool harness 100 provide reliable tethering attachment for pistol-grip hand tools 10. Tool harness 100 is particularly suited for pistol-grip hand tools 10 having a weight of five pounds or more. By using embodiments of tool harness 100 to tether pistol-grip hand tool 10, safety is improved and the risk of damage or personal injury is reduced.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A method of tethering a pistol-grip hand tool comprising:

providing a pistol-grip hand tool having a tool body with a top surface, a gear housing on a forward end of the tool body, and a hand grip extending transversely down from the tool body;

providing a tool harness for drop prevention comprising:

a sleeve member sized and constructed to be installed around the gear housing of the pistol-grip hand tool;

a tool body strap defining a flattened closed loop that extends around a wall of the sleeve member, the tool body strap extending to a rearward end portion spaced apart from the sleeve member; and a handle strap fixedly attached to the rearward end portion of the tool body strap and having a first handle strap portion extending down from a first side of the tool body strap to a first handle strap end portion defining a first closed loop and having a second handle strap portion extending down from a second side of the tool body strap to a second handle strap end portion defining a second closed loop, wherein the first closed loop is sized to permit passage therethrough by the second handle strap end portion;

installing the sleeve member around the gear housing of the pistol-grip hand tool;

aligning the tool body strap to extend rearwardly from the sleeve member along the tool body;

positioning the handle strap to extend over the top surface of the tool body with the first handle strap portion extending down along a first side of the hand grip of the pistol-grip hand tool and the second handle strap extending down along an opposite second side of the hand grip of the pistol-grip hand tool; and inserting the second handle strap end portion through the first closed loop on the first handle strap end portion.

2. The method of claim 1, wherein the providing step includes selecting the sleeve member as heat-shrink tubing and the step of installing the sleeve member includes heating the heat-shrink tubing to cause the shrink tubing to conform to the size and shape of the gear housing.

3. The method of claim 1 further comprising:

providing a handle band sized and constructed to be installed around and tightened on the handle strap and the hand grip of the pistol-grip hand tool as the handle strap extends along the hand grip; and installing the handle band around the hand grip with the first handle strap portion and the second handle strap portion extending down along opposite lateral sides of the hand grip, wherein the first handle strap portion and the second handle strap portion each extends between the hand grip and the handle band; and tightening the handle band around the hand grip and the handle strap, thereby restricting movement of the first handle strap portion and the second handle strap portion.

4. The method of claim 3, wherein the handle band is selected from the group consisting of heat-shrink tubing, cold-shrink tubing provided in an expanded state over a removable core, elastomeric tubing, a strap, a length of self-amalgamating tape, and a length of adhesive tape.

5. The method of claim 4, wherein the handle band is the cold-shrink tubing provided in the expanded state and wherein the step of tightening the handle band includes removing the removable core to cause the cold-shrink tubing to assume a reduced size and snugly grip the hand grip and handle strap.

6. The method of claim 3, wherein the handle band is fixedly attached to the first handle strap portion or the second handle strap portion.

7. The method of claim 4, wherein the handle band is selected as the strap and wherein the strap extends generally perpendicularly to the first handle strap portion or the second handle strap portion.

8. The method of claim 1 further comprising:

providing a tether having a first tether end and a second tether end;

attaching the first tether end to the second closed-loop on the second handle-strap end portion; and attaching the second tether end to the user.

9. The method of claim 1, wherein the step of providing the pistol-grip hand tool includes selecting the hand grip extending down from the tool body at an angle from 90 to 110 degrees.

10. The method of claim 1, wherein the step of providing the tool harness includes selecting the tool harness including a first tool body strap configured to extend along a side surface of the tool body and a second tool body strap configured to extend along an opposite side surface of the tool body.

* * * * *